United States Patent [19]

Shimoma et al.

[11] Patent Number: 4,935,663

[45] Date of Patent: Jun. 19, 1990

[54] ELECTRON GUN ASSEMBLY FOR COLOR CATHODE RAY TUBE APPARATUS

[75] Inventors: Taketoshi Shimoma, Isesaki; Shinpei Koshigoe, Fukaya; Takahiro Hasegawa, Gyoda; Masakazu Takaki, Fukaya, all of Japan

[73] Assignee: Kabushiki Kaisha Toshiba, Kawasaki, Japan

[21] Appl. No.: 323,871

[22] Filed: Mar. 15, 1989

[30] Foreign Application Priority Data

Mar. 17, 1988 [JP] Japan ..... 63-61869

[51] Int. Cl.[5] ..... H01J 29/54; H01J 29/56; H01J 29/96

[52] U.S. Cl. ..... 313/412; 313/414; 313/449; 313/460; 315/3; 315/16; 315/368; 315/382

[58] Field of Search ..... 313/409, 412, 414, 449, 313/460; 315/3, 15, 16, 368, 382

[56] References Cited

U.S. PATENT DOCUMENTS

| | | | |
|---|---|---|---|
| 3,679,930 | 7/1972 | Colvin et al. | 315/21 R |
| 3,995,194 | 11/1976 | Blacker, Jr. et al. | 315/16 |
| 4,041,428 | 8/1977 | Kikuchi et al. | 335/210 |
| 4,122,422 | 10/1978 | Hasegawa et al. | 335/213 |
| 4,672,269 | 6/1987 | Kamohara | 315/3 |
| 4,701,677 | 10/1987 | Ashizaki et al. | 315/382 |
| 4,712,043 | 12/1987 | Takenaka et al. | 315/15 |

FOREIGN PATENT DOCUMENTS

| | | |
|---|---|---|
| 1173977 | 9/1984 | Canada . |
| 2179493 | 3/1987 | United Kingdom . |

*Primary Examiner*—Kenneth Wieder

*Attorney, Agent, or Firm*—Cushman, Darby & Cushman

[57] ABSTRACT

In an electron gun assembly, three electron beams emitted from cathodes are passed through an electrode arrangement in which two intermediate electrodes are arranged between focusing are accelerating electrodes. A focusing voltage which is varied depending on an deflection of the electron beam is applied to the focusing electrode and an accelerating voltage is applied to the accelerating electrode. A resistor is connected between the accelerating electrode and the earth through a variable resistor and intermediate points of the resistor are connected to the intermediate electrodes. Thus, convergent and divergent lenses are formed between the focusing electrode and the intermediate electrode and between the accelerating electrode and the intermediate electrode. The lens powers of the convergent and divergent lenses are varied in accordance with the adjustment of the variable resistor.

23 Claims, 9 Drawing Sheets

ELECTRON GUN ASSEMBLY FOR COLOR CATHODE RAY TUBE APPARATUS

BACKGROUND OF THE INVENTION

1. Field of the Invention

The present invention relates to an electron gun assembly improved in its resolution and capable of keeping its focus grade uniform, and more particularly to an improvement of an electron gun assembly disclosed in U.S. Ser. No. 223,332, now U.S. Pat. No. 4,897,575.

2. Description of the Related Art

Electron gun assemblies which are called the three electron gun type are usually employed in the color cathode ray tube and most of them belong to the electron gun assembly of the in-line type in which three electron guns are aligned on a line. In the case of the color cathode ray tube apparatus provided with the electron gun assembly of the in-line type, inhomogeneous magnetic fields are used to deflect electron beams. More specifically, deflecting magnetic field of the pincushion type is used as horizontally deflecting one and deflecting magnetic field of the barrel type as vertically deflecting one to cause the three electron beams to be self-converged on a point above the screen and focused on the screen. The color cathode ray tube of this self-convergence type can reduce the amount of current used to contribute to enhancing its quality and capacity, and it has become the most popular color cathode ray tube today.

In the case of the color cathode ray tube apparatus of the self-convergence type, however, it has been found that deflecting magnetic fields of non-uniformity causes the resolution to be lowered at the pheripheral region of the screen in the color cathode ray tube. The section of the electron beams is distorted as the electron beam is deflected, and the beam spot can be kept as a true circle at the center portion of the screen but it is changed at the pheripheral region of the screen, overlapping a low bright halo, longer in the vertical direction, upon a high bright ellipse-like core, longer in the horizontal direction. This causes the resolution to be lowered at the pheripheral region of the screen. This distortion of the electron beam spot is resulted from the fact that a deflection yoke applies inhomogeneous magnetic fields to the three electron beams, causing the electron beams in deflecting magnetic fields to be gently focused in the horizontal direction but sharply in the vertical direction.

An electron gun assembly capable of preventing the resolution from being lowered because of this distortion of the electron beam spot is disclosed in U.S. patent Ser. No. 223,332, filed July 25, 1988 now U.S. Pat. No. 4,897,575. In the case of this electron gun assembly, a main lens section is formed between focusing and final accelerating electrodes, one or plural intermediate electrodes are located between the focusing and the final accelerating electrode, and a resistor located adjacent to the electron gun serves to divide final accelerating voltage applied into those of a certain value which are applied to the intermediate electrodes. Further, those sides of the focusing and final accelerating electrodes which face the intermediate electrodes are formed as plates each having openings to form a quadrupole lens, and voltage which rises synchronous with the electron beams deflected is applied to the focusing electrode. The electron gun assembly arranged in this manner allows the resolution to be improved at the center region of the screen and it can be therefore incorporated into the color cathode ray tube of the common type in which the focusing voltage is fixed.

In the case of the electron gun assembly in which the main lens is designed as the quadrupole lens, however, the vertical diameter of the electron beam is mainly adjusted while leaving its horizontal diameter almost not adjusted when adjustment is made relative to focusing voltage.

Upon adjusting focusing voltage, therefore, a compromise must be made between adjustments of beam diameter in the vertical and horizontal directions. This makes it impossible for the electron gun assembly to give full scope to its original capacity.

The conventional technique of dividing the focusing electrode into at least two pieces and using the quadrupole lens between the focusing electrodes to adjust the vertical focusing of electron beams independently of the horizontal focusing thereof is used in some industrial fields, but interference is strong in the vertical and horizontal directions in the case of this technique. In other words, when the focusing of electron beams is adjusted in one or vertical direction, the focusing of electron beams which has been adjusted in the other or horizontal direction must come to be adjusted again. Further, the focusing of the electron beams is adjusted by two potentials of high voltage. This causes conventional parts such as the stem pins and focus pack to be exchanged.

U.S. Pat. No. 4,672,269 proposes providing a variable resistor connected to the earthed terminal of a resistor outside the tube to achieve focus adjustment, but the focus adjustment is carried out using one potential in this case and this patent says nothing about adjusting the focusing of the electron beams in the vertical direction independently of adjusting it in the horizontal direction.

U.S. Pat. No. 3,995,194 discloses an electron gun assembly of the so-called try potential type. The focusing of electron beams is adjusted using two potentials in the case of this electron gun, but its main lens system is of the rotationally symmetrical type and it teaches no concept of adjusting the vertical diameter of the beam spot independently of the adjustment of horizontal diameter of the beam spot.

When focus adjustment is to be carried out, a compromise is only made between adjustments in the vertical and horizontal directions in the case of the conventional electron gun assemblies, as described above. In the case of the electron gun assembly in which the focusing of the electron beams is adjusted using two potentials, interference is strong in the both vertical and horizontal directions and this makes it difficult to adjust the focusing of the electron beams. Further, the focusing of the electron beams is adjusted by two potentials of high voltage, thereby causing conventional parts such as the stem pin and focus pack to be exchanged.

SUMMARY OF THE INVENTION

The object of the present invention is therefore to provide a color cathode ray tube apparatus uniform in focus quality and capable of reliably adjusting the electron beam spot in the vertical and horizontal directions without exchanging conventional parts such as the stem pins and focus pack.

According to the present invention, there can be provided an electron gun assembly for a cathode ray tube apparatus comprising means for emitting an electron beam, an electrode arrangement for allowing the electron beam to pass therethrough, which includes focusing and accelerating electrodes and an intermediate electrode located between the focusing and asselerating electrodes, means for applying a variable focusing voltage to the focusing electrode to maintain the focusing electrode at an focusing potential, means for applying a high voltage to the accelerating electrode to maintain the accelerating electrode at a high potential, resistor means having one and other ends and an intermediate point, the one end being connected to the high voltage generating means and the accelerating electrode and the intermediate point being connected to the intermediate electrode, thereby the high voltage being divided by the resistor means and an intermediate potential being applied to the intermediate electrode through the intermediate point, an electrical convergent lens for converging the electron beam in a first plane and a second plane perpendicular to the first plane, which is formed between the intermediate electrode and the focusing electrode by a potential difference between the varied focusing potential and the intermediate potential, the convergent lens having different first and second converging lens powers in the first and second planes, the first lens power being larger than the second lens power and being varied in accordance with the varied focusing potential, an electrical divergent lens for diverging the electron beam in a first plane and a second plane, which is formed between the intermediate electrode and the accelerating electrode by a potential difference between the high potential and the intermediate potential, the divergent lens having different third and forth divergent lens powers in the first and second planes, the third lens power being larger than the forth lens power, and means, connected to the other end of the resistor means, for varying a intermediate potential to change the focusing and diverging lens powers.

DETAILED DESCRIPTION OF THE PREFERRED EMBODIMENTS

Figure 1A:
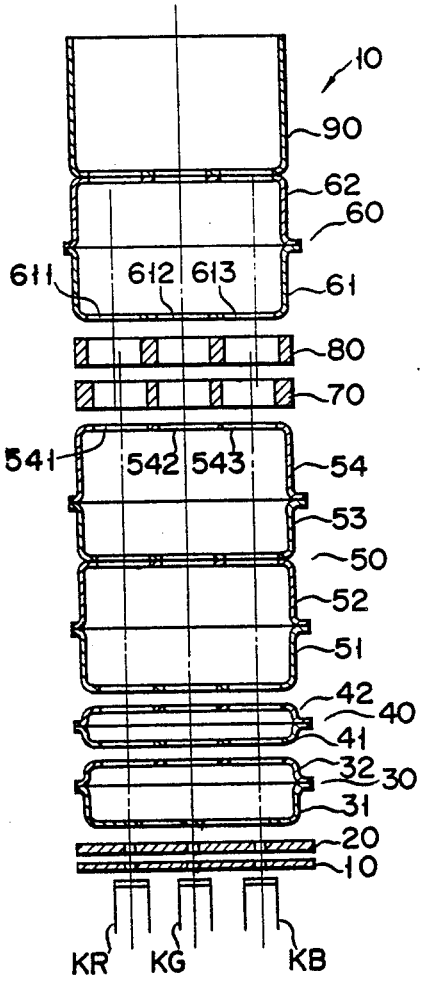
FIGS. 1A and 1B are sectional views taken along vertical and horizontal planes to show an example of the electron gun assembly for color cathode ray tube apparatus according to the present invention.
Figure 1B:
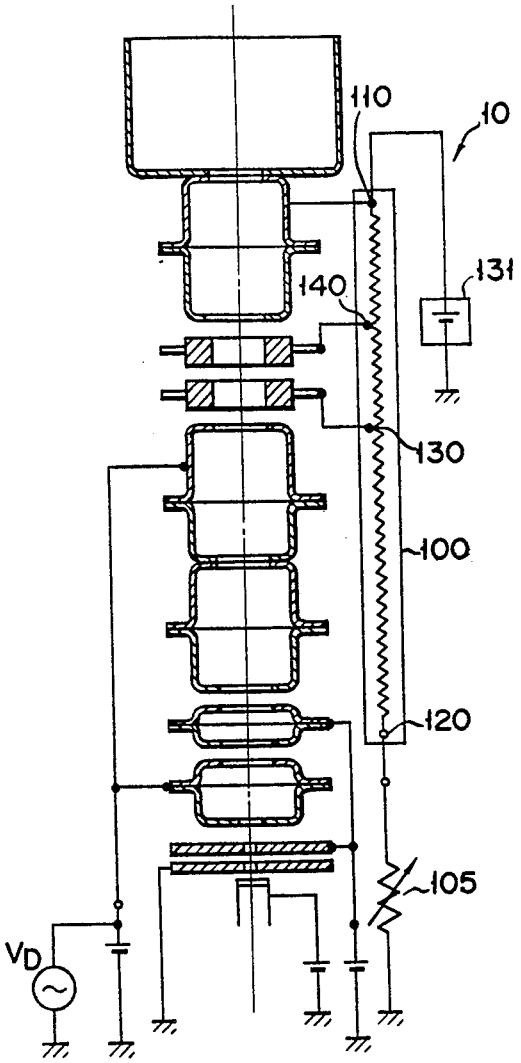

FIGS. 1A and 1B are sectional views showing an example of the electron gun assembly embodied according to the present invention and used in the color cathode ray tube apparatus. As shown in FIG. 1A the electron gun assembly includes three cathodes (KR), (KG) and (KB) provided with heaters (not shown) therein and aligned on a straight line, and convergence cup 90 is located on the side of the screen (not shown). Located between convergence cup 90 and cathodes (KR), (KG), (KB) are first, second, third, fourth, fifth eiectrodes 10, 20, 30, 40, 50, plural intermediate electrodes 70, 80 and sixth electrode 60 in this order, which are supported and fixed by insulation support rods (not shown), as disclosed by U.S. Pat. No. 4,712,043. Resistor 100 is located adjacent to the electron gun assembly and it is connected to sixth electrode 60 at its one end 110, earthed at its other end 120 through a variable resistor 105 or a variable power source 163, and connected to intermediate electrodes 70 and 80 at its intermediate points 130 and 140, as shown in FIG. 1B. Operation power source 131 is also connected to one end 110 of resistor 100.

First electrode 10 is formed as a thin plate electrode provided with three through-holes each having a relatively small diameter and allowing its corresponding electron beam to pass therethrough. Second electrode 20 is similarly made as a thin plate electrode provided with three through-holes each having a relatively small diameter and allowing its corresponding electron beam to pass therethrough. Third electrode 30 is formed by connecting two cup-like electrodes 31 and 32 at their open sides and electrode 31 located on the side of the second electrode has three through-holes each having a diameter a little larger than that of the through-hole of second electrode 20 and allowing its corresponding electron beam to pass therethrough. Electrode 32 located on the side of the fourth electrode also has three through-holes each having a relatively large diameter. Fourth electrode 40 is made by connecting two cup-like electrodes 41 and 42 at their open sides and each of electrodes 41 and 42 has three through-holes each having a relatively large diameter. Fifth electrode 50 comprises plural cup-like electrodes 51, 52, 53 and 54 and each of them has three through-holes each having a relatively large diameter. Intermediate electrodes 70 and 80 are like thick plates and each of them has three through-holes each having a relatively large diameter. Sixth electrode 60 comprises two cup-like electrodes 61 and 62 each having three through-holes. Convergence cup 90 is fixed to the cup-like electrode 62. All of the through-holes of these first through sixth electrodes are made circular.

DC voltage of about 150 V, for example, and video signals which represent images are applied to cathodes (KR), (KG) and (KB). First electrode 10 is earthed and voltage of about 600 V is applied to second electrode 20. Cathodes (KR), (KG), (KB), first and second electrodes 10 and 20 form a triode where electron beams emitted from cathodes (KR), (KG) and (KB) are crossed over with one another. Third and fifth electrodes 30 and 50 are connected with each other in the neck of the tube and focusing voltage of about 7 KV is applied to them. Fourth electrode 40 is connected to second electrode 20 in the neck of the tube. Final accelerating voltage of about 25–30 KV is applied to sixth electrode 60.

Second and third electrodes 20 and 30 form a prefocusing lens by which the electrode beams emitted from the triode are pre-focused. Third, fourth and fifth electrodes 30, 40 and 50 form an auxiliary lens by which the electron beams are further pre-focused.

Resistor 100 divides high voltage, causing about 40% of the high voltage to be applied to intermediate electrode 70 while about 65% of it to be applied to intermediate electrode 80. Variable resistor 105 located outside the tube is connected to other end 120 of resistor 100 and voltages of intermediate electrodes 70 and 80 are made variable by variable resistor 105. Fifth electrode 50, intermediate electrodes 70, 80 and sixth electrode 60 form a main lens by which the electron beams are finally focused on the screen. This main lens system is called extended-field lens system because the area of the main lens system is extended by intermediate electrodes 70 and 80. The main lens system can be used as having a long focal length. If the details of the electron gun assembly shown in FIGS. 1A and 1B are needed, please refer to U.S. patent Ser. No. 223,332 filed July 25, 1988.

Figure 2:
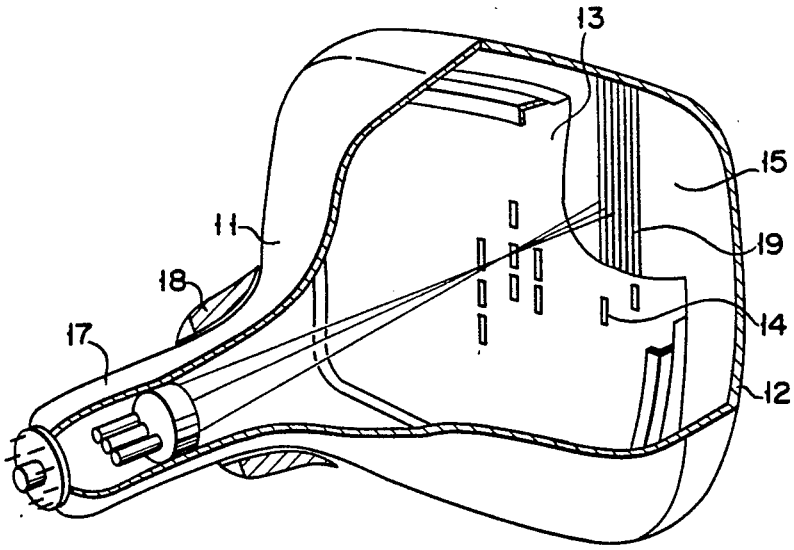
FIG. 2 is a perspective view showing a color cathode ray tube apparatus into which the electron gun assembly shown in FIGS. 1A and 1B are incorporated.

The electron gun assembly shown in FIGS. 1A and 1B is located in neck 17 of the color cathode ray tube as shown in FIG. 2. The envelope of this cathode ray tube is well known. Funnel 11 is continuous from neck 17 and connected to the skirt of panel 12. Phosphor screen 15 is formed on the inner face of a face plate at panel 12. Shadow mask 13 having a plurality of slit apertures is so fixed in panel 12 as to face screen 15. Deflection yoke 18 is arranged a round funnel 11 of the tube and the electron beams emitted from the electron gun assembly are deflected by deflecting magnetic field caused by deflecting yoke 18, so that screen 15 can be scanned by the electron beams to display images thereon. As already described at the background of the present invention. pin cushion deflecting magnetic field is used as horizontally deflecting magnetic field, while barrel deflecting magnetic field as vertically deflecting magnetic field.

Figure 3A:
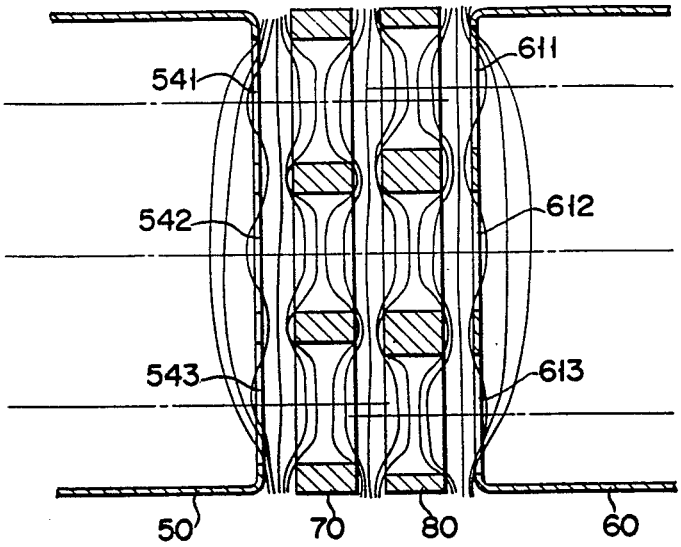
FIGS. 3A and 3B show the equipotential distribution of a main lens system in the electron gun assembly shown in FIGS. 1A and 1B.
Figure 3B:
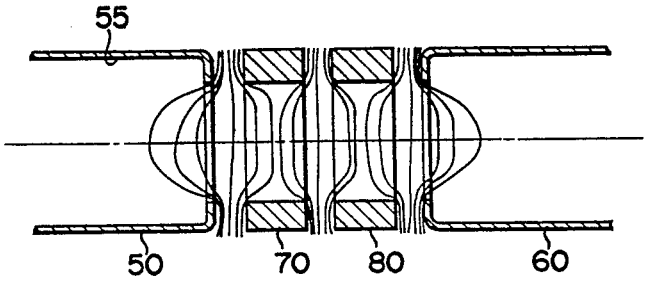

Equipotential distribution formed at the area of the main lens of the electron gun assembly shown in FIGS. 1A and 1B will be described with reference to FIGS. 3A and 3B. FIG. 3A is a sectional view taken along the horizontal direction in the horizontal plane of the main lens area and FIG. 3B is a sectional view taken along the vertical direction in the vertical plane of the main lens area. Focusing electric field enters gently into fifth electrode 50 and it forms common equipotential lines even in center and side holes 542 and 541, 543 in the horizontal plane shown in FIG. 3A. Because fifth electrode 50 has an inner diameter longer in the horizontal direction than in the vertical direction thereof, focusing electric field is influenced by side walls 55 of electrode 50 to quickly enter into fifth electrode 50 in the vertical plane shown in FIG. 3B and the curvature of equipotential lines is thus made larger in the vertical plane than in the horizontal plane. In short, focusing function is made relatively higher in the vertical plane than in the horizontal plane. As apparent from the comparison of FIG. 2A with FIG. 2B, diverging electric field entering into sixth electrode 60 is made relatively stronger in the vertical plane than in the horizontal plane. Parallel equipotential lines are formed between intermediate electrodes 70 and 80 and focusing electric field is thus separated from diverging electric field.

Figure 4A:
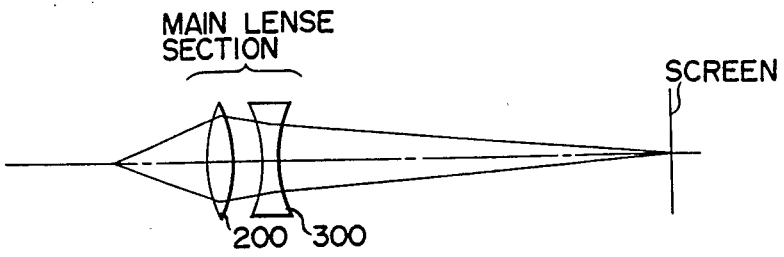
FIGS. 4A and 4B are optical models showing the main lens system of the electron gun assembly in vertical and horizontal plates.
Figure 4B:
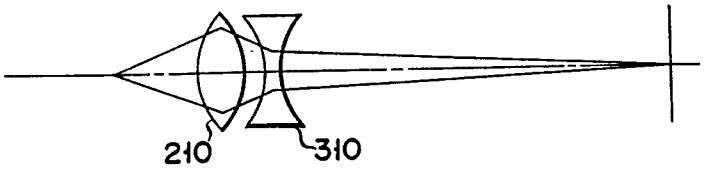

In the case of the electron gun assembly shown in FIGS. 1A and 1B, the main lens system is a combination of focusing and diverging lenses formed by focusing and diverging electric fields which are separated from each other and made independent of the other, and the focusing lens has a focusing force relatively stronger in the vertical plane while the diverging lens has a diverging force relatively stronger also in the vertical plane, as already described above. The arrangement of this main lens system is represented by an optical model shown in FIGS. 4A and 4B. As shown in FIG. 4A, the electron beams are relatively gently or weakly focused in the horizontal plane by convex lens section 200 which is regarded as the focusing electric field or lens of the main lens system, while they are relatively gently or weakly diverged in the vertical plane by concave lens section 300 which is regarded as the diverging electric field or lens of the main lens system. As shown in FIG. 4B, on the other hand, the electron beams are relatively sharply or strongly focused in the vertical plane by convex lens section 210 while they are relatively sharply or strongly diverged in the vertical plane by concave lense sections 310. Although the electron beams are subjected to focusing and diverging forces different in the horizontal and vertical planes, the beam spot of each of them formed on the screen has a diameter equal in the horizontal and vertical planes.

In the case of the electron gun assembly disclosed by U.S. patent Ser. No. 223,332 and intended to adjust focusing voltage in accordance with the amount of the electron beam deflected, the vertical diameter of the electron beam is changed while keeping the horizontal diameter thereof almost unchanged, as apparent from the above. The beam diameter in the horizontal plane does not become equal to that in the vertical plane, accordingly, and each of the beam spots in the center of the screen is shaped like a non-circle, longer in the vertical or horizontal direction. In the case of focus-adjusting these beams, therefore, a compromise is usually made between the adjustment in the vertical plane and that in the horizontal plane.

Figure 5A:
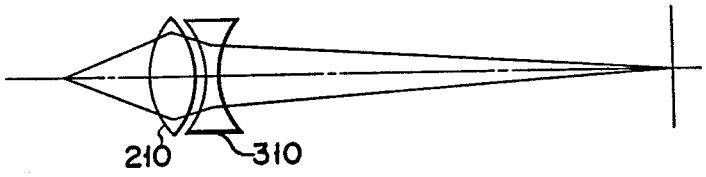
FIGS. 5A, 5B and 6A, 6B are optical models intended to explain the operation of the electron gun assembly shown in FIGS. 1A and 1B.
Figure 5B:
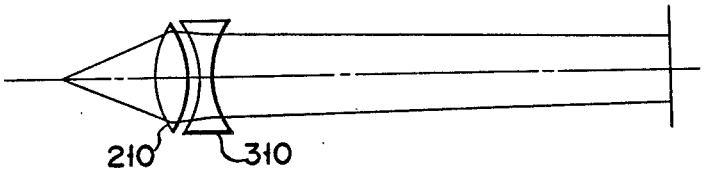
Figure 6A:
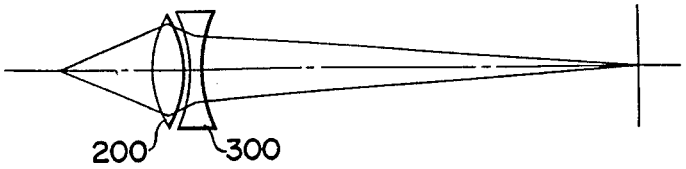
Figure 6B:
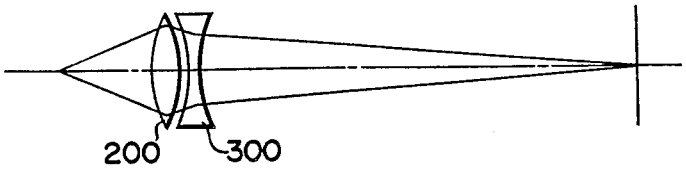

Focusing and diverging electric fields are separated from each other and made independent of the other by intermediate electrodes 70 and 80 in the case of the electron gun assembly shown in FIGS. 1A and 1B. When focusing voltage is changed, therefore, only the focusing action can be changed without changing the diverging action. The electron beams are subjected to the action of lens more strongly in the vertical plane than in the horizontal plane. When focusing voltage is changed, therefore, the beams can be focus-adjusted only in the vertical plane. The focusing voltage of the main lens system shown in FIG. 5A, for example, is raised, the lens power of convex lens section 210 becomes small in the vertical plane, as shown in FIG. 5B, because potential difference between the focusing electrode and the intermediate electrode located adjacent to this focusing electrode becomes low. The lens power of concave lens section 310 which is represented by diverging electric field is left unchanged in the vertical plane because potential difference between intermediate electrode 80 and final accelerating electrode 60 is not changed. When focusing voltage is changed, therefore, the lens power of convex lens section 210 is changed only in the vertical plane. When the focusing voltage of the main lens system shown in FIG. 6A is raised, the lens power of convex lens section 200 which corresponds to the focusing electric field in the horizontal plane changes to become small same as in the vertical plane, as shown in FIG. 6B, but the changing rates of lens power of convex lens sections 210 and 200 are extremely smaller in the horizontal direction when focusing voltage is changed, because the lens has a lens power extremely smaller in the horizontal direction than in the vertical direction. The main lens section has therefore a lens power almost unchanged in the horizontal direction as it has under its original state.

Figure 7:
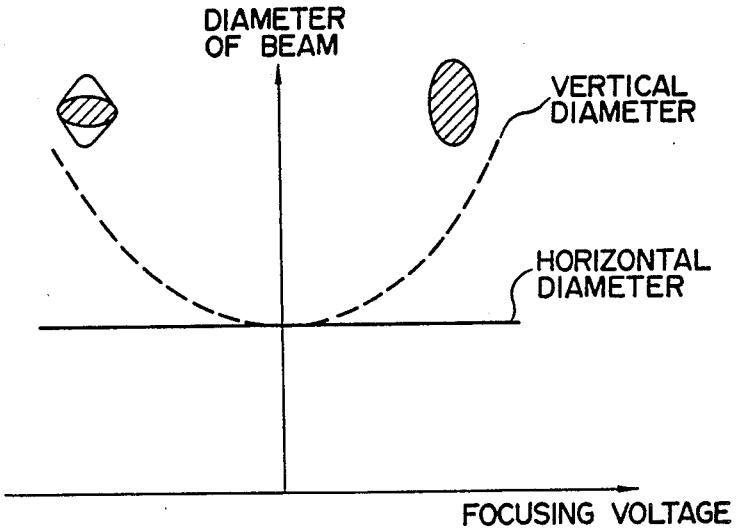
FIG. 7 shows how the diameter of the electron beam spot is changed as focusing voltage of the electron gun assembly shown in FIGS. 1A and 1B changes.

As apparent from the above, the beam spot changes in shape as shown in FIG. 7 and focus adjustment can be attained only in the vertical direction when focusing voltage is changed.

Figure 8A:
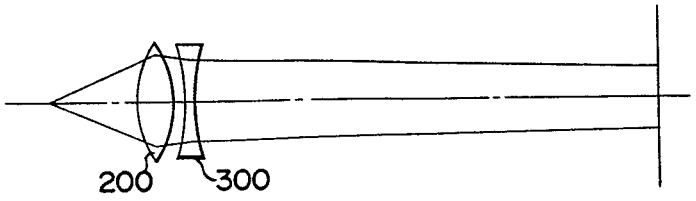
FIGS. 8A and 8B are optical models showing the main lens system in the vertical and horizontal planes to explain the operation of the electron gun assembly shown in FIGS. 1A and 1B.
Figure 8B:
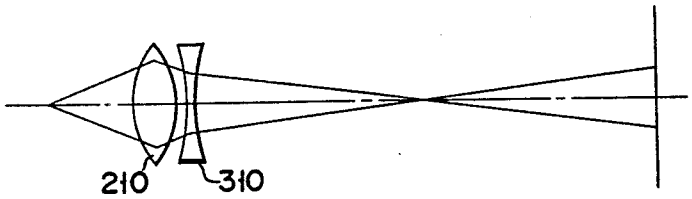

When resistor 105 attached to the earthed terminal of resistor 100 is made variable, the dividing ratio of resistor 100 can be changed and voltages applied to intermediate electrodes 70 and 80 are made variable. The balance of asymmetrical focusing electric field relative to asymmetrical diverging electrical field can be changed accordingly and the aspect ratio of the beam spot on the screen can be thus changed. The electron beams are over focused in the vertical plane and asymmetrical electric field acts on the electron beams to extend them in the horizontal direction in asymmetrical focusing electric field. On the other hand, the electron beams are under-focused in the vertical plane and asymmetrical electric field acts on the electron beams to extend them in the vertical direction in asymmetrical diverging electric field. When the resistance value of variable resistor 105 is set large, for example, potential is raised at the earthed terminal of resistor 100 and potentials of intermediate electrodes 70 and 80 are also raised. Potential difference between intermediate and focusing electrodes 70 and 50 becomes large under this state, as shown in FIGS. 8A and 8B. Therefore, lens powers of convex lens sections 200 and 210 which is denoted by focusing electric field become strong or large in the vertical and horizontal planes, particularly in the vertical plane. As potential difference between intermediate and final accelerating electrodes 80 and 60 becomes small, lens powers of concave lens sections 300 and 310 become weak or small in the vertical and horizontal planes, particularly in the vertical plane. As described above, therefore, asymmetrical focusing electric field become strong while asymmetrical diverging electric field becomes weak. The beam spot is thus extended in the horizontal direction. In a case where the resistance value of variable resistor 105 is set small, however, the beam spot is extended in the vertical direction.

Figure 9A:
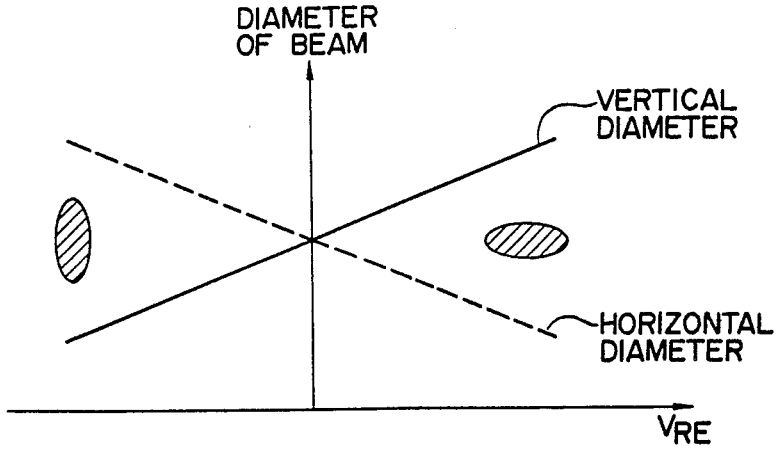
FIGS. 9A and 9B show how the diameter of the electron beam spot is changed as voltage at the earthed terminal of a resistor of the electron gun assembly shown in FIGS. 1A and 1B changes.
Figure 9B:
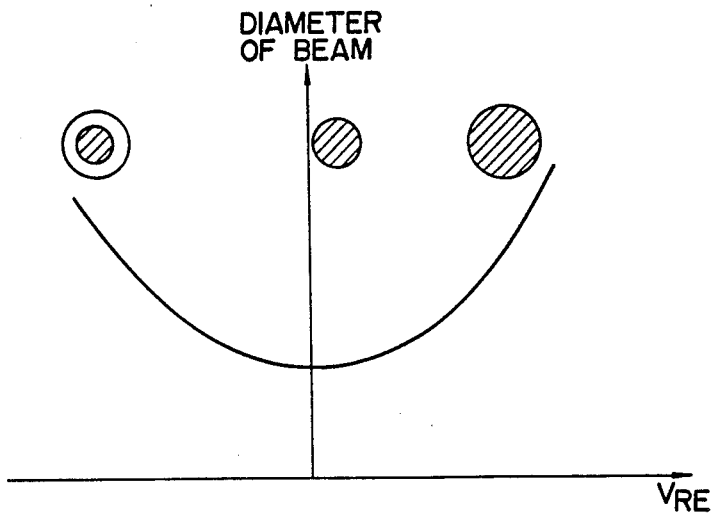

FIG. 9A shows how the aspect ratio of the beam spot is changed as potential (VRE) at the earthed terminal of resistor 100 changes. When the resistance of variable resistor 105 is changed to change potentials of intermediate electrodes 70 and 80, the imaging system of the whole main lens section is also changed. When the resistance of variable resistor 105 is set large and potentials of intermediate electrodes 70 and 80 are raised, the imaging system is under-focused as a whole. When the resistance of variable resistor 105 is set small and potentials of intermediate electrodes 70 and 80 are lowered, however, the imaging system is over-focused. FIG. 9B shows how the focusing or beam spot is changed as potential (VRE) at the earthed terminal of resistor 100 changes.

Figure 10A:
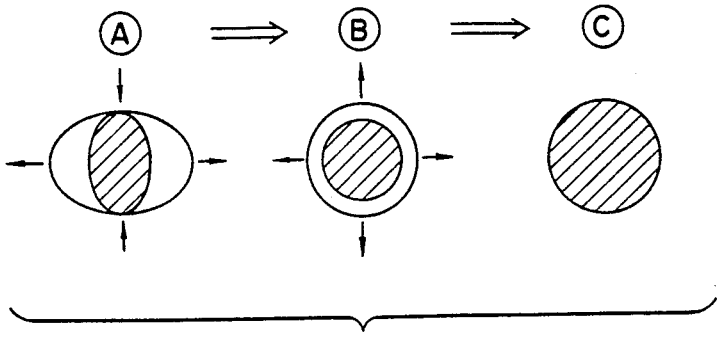
FIGS. 10A and 10B are intended to explain the operation of adjusting the focusing of the electron beams.
Figure 10B:
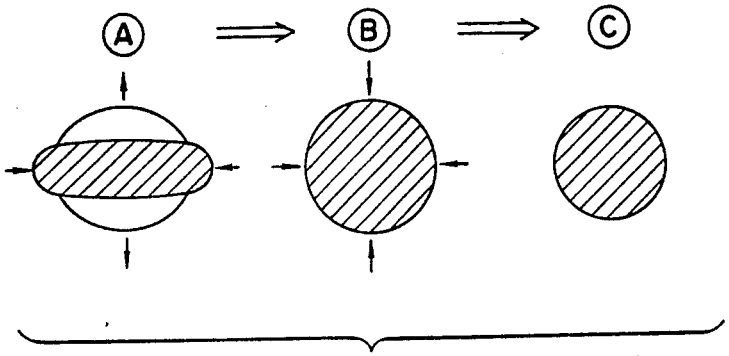

A case where focus adjustment is carried out by changing the resistance value of variable resistor 105 connected to the earthed terminal of resistor 100 will be described. When a beam spot having halos in the horizontal direction or longer in the vertical direction is formed, as shown in FIG. 10A, the resistance value of variable resistor 105 is set large and potentials of intermediate electrodes 70 and 80 are raised. Because the asymmetrical lens serves to extend the electron beam in the horizontal direction, therefore, the beam shown by (A) in FIG. 10A is changed to the one shown by (B) in FIG. 10A. The imaging system is changed at the same time and under-focused as a whole. The electron beam is thus changed to have such a normal shape as shown by (C) in FIG. 10A. Therefore, focus adjustment only in the horizontal direction can be carried out without changing the diameter of the electron beam in the vertical direction. When a beam having halos in the vertical direction or longer in the horizontal direction is formed, the resistance value of variable resistor 105 is set small and potentials of intermediate electrodes 70 and 80 are lowered. Because the asymmetrical lens serves to extend the electron beam in the vertical direction, therefore, the beam shown by (A) in FIG. 10B is changed to the one shown by (B) in FIG. 10B. The imaging system is changed at the same time and over focused as a whole. The electron beam is thus changed to have such a normal shape as shown by (C) in FIG. 10B. Therefore, focus adjustment only in the horizontal direction can be carried out without changing the diameter of the electron beam in the vertical direction. When the resistance value of variable resistor 105 is changed, therefore, focus adjustment only in the horizontal direction can be attained without changing the diameter of the electron beam in the vertical direction.

Figure 11A:
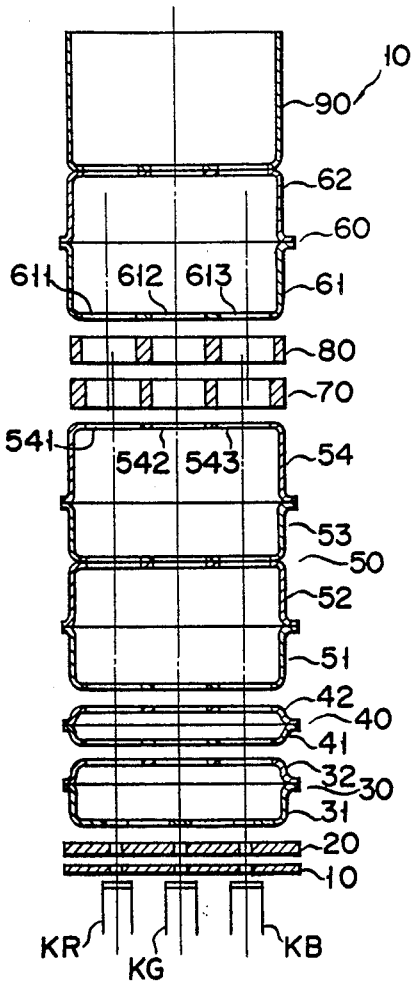
FIGS. 11A and 11B are sectional views showing another example of the electron gun assembly for color cathode ray tube apparatus according to the present invention.
Figure 11B:
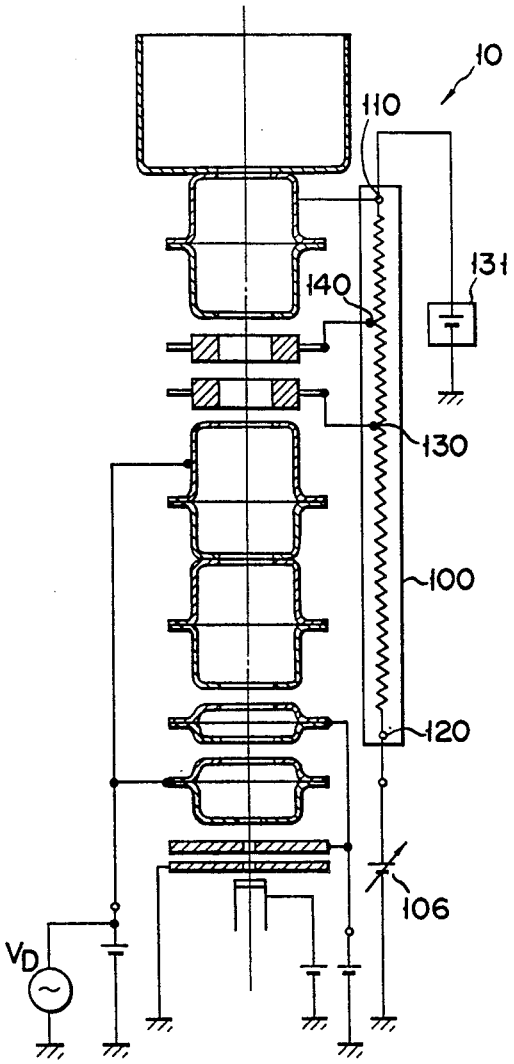

Although variable resistor 105 has been connected to the lower end of resistor 100 in the case of the above-described embodiment according to the present invention, variable voltage 106 may be applied to the earthed terminal of resistor 100, as shown in FIG. 11.

Although the present invention has been embodied as an electron gun assembly of the conventional type, it may be applied to the electron gun assembly of the dynamic focus type.

The resistance value of variable resistor 105 connected from outside to the earthed terminal of resistor 100 ranges from 0 [Ω] to 100M [Ω]. The value of voltage applied to the earthed terminal of resistor 100 ranges from 0 V to 1 KV. Focusing voltage is set to about 28% of anode high voltage.

According to the color cathode ray tube apparatus provided with the electron gun assembly of the present invention, focus adjustment of the electron beam in the vertical direction can be attained independently of that in the horizontal direction without making any compromise between adjustments in the vertical and horizontal directions. Further, the electron gun assembly of the present invention allows most of conventional parts such as the stem pins to be used and the rate of these conventional parts used is quite high.

What is claimed is:

1. An electron gun assembly for a cathode ray tube apparatus comprising:

means for emitting electron beam;

an electrode arrangement for allowing the electron beam to pass therethrough, which includes focusing and accelerating electrodes and an intermediate electrode located between the focusing and accelerating electrodes;

means for applying a variable focusing voltage to the focusing electrode to maintain the focusing electrode at an focusing potential;

means for applying a high voltage to the accelerating electrode to maintain the accelerating electrode at a high potential;

resistor means having one and other ends and an intermediate point, the one end being connected to the high voltage generating means and the accelerating electrode and the intermediate point being connected to the intermediate electrode, thereby the high voltage being divided by the resistor means and an intermediate potential being applied to the intermediate electrode through the intermediate point;

an electrical convergent lens for converging the electron beam in a first plane and a second plane perpendicular to the first plane, which is formed between the intermediate electrode and the focusing electrode by a potential difference between the varied focusing potential and the intermediate potential, the convergent lens having different first and second converging lens powers in the first and second planes, the first lens power being larger than the second lens power and being varied in accordance with the varied focusing potential;

an electrical divergent lens for diverging the electron beam in a first plane and a second plane, which is formed between the intermediate electrode and the accelerating electrode by a potential difference between the high potential and the intermediate potential, the divergent lens having different third and forth divergent lens powers in the first and second planes, the third lens power being larger than the forth lens power; and means, connected to the other end of the resistor means, for varying an intermediate potential to change the focusing and diverging lens powers.

2. The electron gun assembly for a cathode ray tube apparatus according to claim 1, wherein the varying means includes a variable resistor connected between the other end of the resistor means and the earth.

3. The electron gun assembly for a cathode ray tube apparatus according to claim 1, wherein the varying means includes a variable power source, connected to the other end of the resistor means, for applying a variable potential to the other end of the resistor means.

4. The electron gun assembly for a cathode ray tube apparatus according to claim 1, wherein the resistor means has a second intermediate point and the electrode arrangement includes a second intermediate electrode located between the first intermediate electrode and the accelerating electrode and connected to the second intermediate point, a second intermediate potential which is larger than the first intermediate potential being applied to the intermediate electrode through the intermediate point.

5. The electron gun assembly for a cathode ray tube apparatus according to clam 4, wherein the electrical divergent lens is formed between the accelerating electrode and the second intermediate electrode and an electrical field for separating the divergent lens from the convergent lens is formed between the first and second intermediate electrodes.

6. The electron gun assembly for a cathode ray tube apparatus according to claim 1, wherein the electrode arrangement includes first and second prefocusing electrodes, located between the emitting means and the focusing electrode.

7. The electron gun assembly for a cathode ray tube apparatus according to claim 6, further comprising:

means for applying the focusing potential to the first prefocusing electrode and a prefocusing potential to the second prefocusing electrode;

a first prefocusing lens, formed between the first and second prefocusing electrodes by a potential difference between the focusing potential and the prefocusing potential, for prefocusing the electron beam; and a second prefocusing lens, formed between the second prefocusing electrodes and the focusing electrode by a potential difference between the focusing potential and the prefocusing potential, for prefocusing the electron beam.

8. An electron gun assembly for color cathode ray tube apparatus comprising:

means for emitting three electron beams;

an electrode arrangement for allowing the electron beams to pass therethrough, which includes focusing and accelerating electrodes and an intermediate electrode located between the focusing and accelerating electrodes;

means for applying a variable focusing voltage to the focusing electrode to maintain the focusing electrode at an focusing potential;

means for applying a high voltage to the accelerating electrode to maintain the accelerating electrode at a high potential;

resistor means having one and other ends and an intermediate point, the one end being connected to the high voltage generating means and the accelerating electrode and the intermediate point being connected to the intermediate electrode, thereby the high voltage being divided by the resistor means and an intermediate potential being applied to the intermediate electrode through the intermediate point;

electrical convergent lenses, each converging the corresponding electron beam in a first plane and a second plane perpendicular to the first plane, which is formed between the intermediate electrode and the focusing electrode by a potential difference between the varied focusing potential and the intermediate potential, the convergent lens having different first and second converging lens powers in the first and second planes, the first lens power being larger than the second lens power and being varied in accordance with the varied focusing potential;

electrical divergent lenses, each diverging the corresponding electron beam in a first plane and a second plane, which is formed between the intermediate electrode and the accelerating electrode by a potential difference between the high potential and the intermediate potential, the divergent lens having different third and forth divergent lens powers in the first and second planes, the third lens power being larger than the forth lens power; and means, connected to the other end of the resistor means, for varying a intermediate potential to change the focusing and diverging lens powers.

9. The electron gun assembly for a color cathode ray tube apparatus according to claim 8, wherein the varying means includes a variable resistor connected between the other end of the resistor means and the earth.

10. The electron gun assembly for a color cathode ray tube apparatus according to claim 8, wherein the varying means includes a variable power source, connected to the other end of the resistor means, for applying a variable potential to the other end of the resistor means.

11. The electron gun assembly for a color cathode ray tube apparatus according to claim 8, wherein the resistor means has a second intermediate point and the electrode arrangement includes a second intermediate electrode located between the first intermediate electrode and the accelerating electrode and connected to the second intermediate point, a second intermediate potential which is larger than the first intermediate potential being applied to the intermediate electrode through the intermediate point.

12. The electron gun assembly for a color cathode ray tube apparatus according to claim 11, wherein the electrical divergent lenses are formed between the accelerating electrode and the second intermediate electrode and an electrical field for separating the divergent lenses from the convergent lenses is formed between the first and second intermediate electrodes.

13. The electron gun assembly for a cathode ray tube apparatus according to claim 8, wherein the electrode arrangement includes first and second prefocusing electrodes, located between the emitting means and the focusing electrode.

14. The electron gun assembly for a color cathode ray tube apparatus according to claim 13, further comprising:

means for applying the focusing potential to the first prefocusing electrode and a prefocusing potential to the second prefocusing electrode;

first prefocusing lenses, formed between the first and second prefocusing electrodes by a potential difference between the focusing potential and the prefocusing potential, each prefocusing the corresponding electron beam; and second prefocusing lenses, formed between the second prefocusing electrodes and the focusing electrode by a potential difference between the focusing potential and the prefocusing potential, each prefocusing the corresponding electron beam.

15. A color cathode ray tube apparatus comprising:

an envelope having an inner surface;

means for emitting three electron beams, which is received in the envelope;

an electrode arrangement for allowing the electron beams to pass therethrough, which is arranged inside of the envelope and includes focusing and accelerating electrodes and an intermediate electrode located between the focusing and accelerating electrodes;

means for applying a variable focusing voltage to the focusing electrode to maintain the focusing electrode at an focusing potential, which is arranged outside of the envelope;

means for applying a high voltage to the accelerating electrode to maintain the accelerating electrode at a high potential, which is arranged inside of the envelope a screen formed on the inter surface of the envelope, to which the three electron beams being focused;

means for generating first and second deflection magnetic fields which deflects the three electron beams in the first and second planes, the first plane being perpendicular to the second plane;

resistor means, which is arranged outside of the envelope and have one and other ends and an intermediate point, the one end being connected to the high voltage generating means and the accelerating electrode and the intermediate point being connected to the intermediate electrode, thereby the high voltage being divided by the resistor means and an intermediate potential being applied to the intermediate electrode through the intermediate point;

convergent means for converging the electron beams in a first plane and a second plane perpendicular to the first plane, which is formed in the envelope between the intermediate electrode and the focusing electrode by a potential difference between the varied focusing potential and the intermediate potential, said convergent means having different first and second converging powers in the first and second planes, the first lens power being larger than the second lens power and being varied in accordance with the varied focusing potential;

divergent means for diverging the corresponding electron beams in a first plane and a second plane, which is formed in the envelope between the intermediate electrode and the accelerating electrode by a potential difference between the high potential and the intermediate potential, said divergent means having different third and fourth divergent powers in the first and second planes, the third lens power being larger than the fourth lens power; and means, connected to the other end of the resistor means and arranged outside of the envelope, for varying an intermediate potential to change the focusing and diverging lens powers.

16. The color cathode ray tube apparatus according to claim 15, wherein the varying means includes a variable resistor connected between the other end of the resistor means and the earth.

17. The color cathode ray tube apparatus according to claim 15, wherein the varying means includes a variable power source, connected to the other end of the resistor means, for applying a variable potential to the other end of the resistor means.

18. The color cathode ray tube apparatus according to claim 15, wherein the resistor means has a second intermediate point and the electrode arrangement includes a second intermediate electrode located between the first intermediate electrode and the accelerating electrode and connected to the second intermediate point, a second intermediate potential which is larger than the first intermediate potential being applied to the intermediate electrode through the intermediate point.

19. The color cathode ray tube apparatus according to claim 18, wherein the divergent means is formed between the accelerating electrode and the second intermediate electrode and an electrical field for separating the divergent means from the convergent means is formed between the first and second intermediate electrodes.

20. The color cathode ray tube apparatus according to claim 15, wherein the electrode arrangement includes first and second prefocusing electrodes, located between the emitting means and the focusing electrode.

21. The color cathode ray tube apparatus according to claim 20, further comprising:

means for applying the focusing potential to the first prefocusing electrode and a prefocusing potential to the second prefocusing electrode;

first prefocusing means, formed between the first and second prefocusing electrodes by a potential difference between the focusing potential and the prefocusing potential, for prefocusing the electron beams; and second prefocusing means, formed between the second prefocusing electrodes and the focusing electrode by a potential difference between the focusing potential and the prefocusing potential, for prefocusing the corresponding electron beams.

22. The color cathode ray tube apparatus according to claim 15, wherein the first and second magnetic fields are pincushion and barrel shaped magnetic fields, respectively.

23. The color cathode ray tube apparatus according to claim 15, wherein the focusing voltage is varied depending on the deflection of the electron beams.

* * * * *